US008167748B2

(12) United States Patent
Butcher

(10) Patent No.: US 8,167,748 B2
(45) Date of Patent: May 1, 2012

(54) FIXED PARALLEL-BLADE BROADHEAD HAVING MODIFIED H-SHAPED OUTLINE CONFIGURATION

(75) Inventor: Robert Butcher, Flushing, MI (US)

(73) Assignee: Eastman Outdoors, Inc., Flushing, MI (US)

( * ) Notice: Subject to any disclaimer, the term of this patent is extended or adjusted under 35 U.S.C. 154(b) by 114 days.

(21) Appl. No.: 12/713,694

(22) Filed: Feb. 26, 2010

(65) Prior Publication Data

US 2010/0222164 A1 Sep. 2, 2010

Related U.S. Application Data

(60) Provisional application No. 61/156,695, filed on Mar. 2, 2009.

(51) Int. Cl.
*F42B 6/08* (2006.01)

(52) U.S. Cl. ..... 473/583

(58) Field of Classification Search ..... 473/578, 473/582, 583, 584
See application file for complete search history.

(56) References Cited

U.S. PATENT DOCUMENTS

| | | | | |
|---|---|---|---|---|
| 2,373,216 | A * | 4/1945 | Zwickey | 473/583 |
| 2,589,137 | A * | 3/1952 | Ramsey | 473/583 |
| 2,880,000 | A * | 3/1959 | Unger | 473/584 |
| 4,210,330 | A * | 7/1980 | Kosbab | 473/584 |
| 6,554,727 | B1 * | 4/2003 | Armstrong et al. | 473/584 |
| 6,863,630 | B1 | 3/2005 | Watkins et al. | |
| 6,966,856 | B1 | 11/2005 | Hajek | |
| 6,997,827 | B1 * | 2/2006 | Grace et al. | 473/583 |
| 7,037,222 | B2 | 5/2006 | Mizek et al. | |
| 7,037,223 | B2 | 5/2006 | Kuhn | |
| 7,160,217 | B2 | 1/2007 | Sohm | |
| 7,255,659 | B2 | 8/2007 | Jones | |

* cited by examiner

*Primary Examiner* — John Ricci
(74) *Attorney, Agent, or Firm* — The Waintraub Group, P.L.C.

(57) ABSTRACT

A broadhead which is light in weight and which has surface area to decrease arrowhead weight, surface area and drag to increase performance of an arrow to which it is attached. The broadhead attaches to the arrow in one of the known ways, glue, screw, friction or interference fit. A broadhead wrench may need to be used to protect the user from sharp edges while handling the broadhead. The blade portion of the broadhead aids in the hemorrhaging of the target by creating a larger conduit for bleeding to occur, thus speeding death of a game animal.

12 Claims, 2 Drawing Sheets

FIXED PARALLEL-BLADE BROADHEAD HAVING MODIFIED H-SHAPED OUTLINE CONFIGURATION

CROSS REFERENCE TO RELATED APPLICATIONS

The present invention claims the benefit of U.S. Provisional Application No. 61/156,695, filed Mar. 2, 2009. The entire subject matter of this priority document, including the specification and drawings thereof, is incorporated by reference herein.

BACKGROUND OF THE INVENTION

1. Field of the Invention

The present invention relates generally to archery arrowheads. More particularly, the present invention relates to improved broadhead-type arrowheads having superior flight and performance characteristics.

2. Description of the Related Art

Broadheads are similar to other arrowheads in that they are designed to be secured to the tip of an archery arrow. When the arrow is shot from an archery bow, the arrowhead is the first part of the arrow/arrowhead combination that impacts a target, which may be a game animal. It is preferable that the broadhead strike and kill the target as quickly and humanely as possible. A problem that often arises with bow hunting concerns the tracking and locating of a wounded or "hit" animal for harvesting.

Wounded animals may suffer after being hit by an arrow, and can become dangerous to the hunter and others. Thus, upon contact with a game animal, a broadhead should inflict as much damage as possible in order to promote bleeding and shorten the time between an arrow strike and resultant death of a game animal.

The presently available broadheads have certain disadvantages in that the speed, distance, and the accuracy of flight of the arrow shaft through the air may be adversely affected by the structural configuration of the broadhead. In addition, there are certain legal requirements setting forth the conditions under which the use and structure of the broadhead arrows must comply.

With the availability of new materials, the method for delivering the arrow has improved considerably. Compound bows have the capability to launch arrows at considerably higher velocities than previous types of bows. Unfortunately, these higher velocities introduce significant aerodynamic problems in maintaining accurate arrow flight with a broadhead attached.

The overall cutting width of prior broadhead designs was reduced to maintain as narrow an aerodynamic profile as possible. This allows the arrow to have an accurate flight, but provides for the chance that a target would only be wounded and not killed. The blades size and arrangement are vital for accurate flight and for efficient killing. Even a narrow blade width can have difficulty in achieving repeatable accurate arrow flights, due to pressure exerted by the wind as the arrow flies to its intended target.

In order to provide a large contact area, broadheads have been designed that expand on impact with a target. These "mechanical broadheads" normally include expandable blades to cause larger damage to the target. These expandable blades offer a combination of both accurate arrow flight and effective harvesting, in a single arrowhead. However, mechanical broadheads have several disadvantages such as, reduced penetration of the broadhead, structural weakness of the elements, and possible inoperability at the critical moment of contact with the game animal.

Blade assemblies have the general shape of a substantially triangular or delta wing configuration, and as such, the blades can act generally like a wing and provide lift for the arrow and cause the arrow to fly off course. Thus, much like the control surfaces of an aircraft wing, the angled portion length to overall blade assembly length can aid or detract in steering the arrow to the target.

Some examples of broadheads are disclosed in the U.S. Pat. Nos. 6,863,630 to Watkins, et al.; 6,966,856 to Hajek; 7,037,222 to Mizek et al.; 7,037,223 to Kuhn; 7,160,217 to Sohm; and 7,255,659 to Jones.

What is needed is a broadhead designed to make an enlarged hole in a target as compared with the previously known broadheads, in order to shorten the time between impact of the arrow with the target and the subsequent immobility of the target.

Accordingly, it is one of the objects of the present invention to provide a broadhead having a reduced aerodynamic drag, thereby decreasing the air turbulence and wind noise generated during flight, and which is configured to kill a game animal as humanely as possible.

SUMMARY OF THE INVENTION

The present invention is directed to a broadhead having a reduced aerodynamic drag, thereby decreasing the air turbulence and wind noise generated during flight. The present invention is accomplished by shaping the broadhead, and in particular the blade, such that the leading surfaces are smoothly shaped. The trailing surfaces may also be shaped to minimize the effects of airflow that tend to increase the drag generated. The geometric configurations may also be shaped to impart rotation of the arrow during flight to enhance the flight dynamics.

It is also advantageous to provide a broadhead that is substantially silent in flight to prevent the target from having the opportunity to "duck" or otherwise move before the arrow arrives.

Accordingly, a feature and advantage of the present invention is its ability to overcome the deficiencies in prior art broadhead arrowheads by providing an improved arrow broadhead in accordance with the disclosure herein.

Another feature and advantage of the present invention is its ability to provide an improved arrow broadhead having improved cutting characteristics.

Further areas of applicability of the present invention will become apparent from the detailed description provided hereinafter. It should be understood that the detailed description and specific examples, while indicating the illustrative embodiments of the invention, are intended for purposes of illustration only, and are not intended to limit the scope of the invention.

DETAILED DESCRIPTION OF ILLUSTRATIVE EMBODIMENTS

Hereinafter, embodiments of the present invention will be described with reference to the attached drawings. A number of working examples of the present invention will be described herein, based on selected illustrative embodiments of the present invention shown in the accompanying drawings.

As used throughout this specification and in the claims, the terms forward and rearward relate to a front and a rear of arrowhead, relative to a direction of flight of an arrow shaft to which the arrowhead is attached, in a conventional manner.

Figure 1:
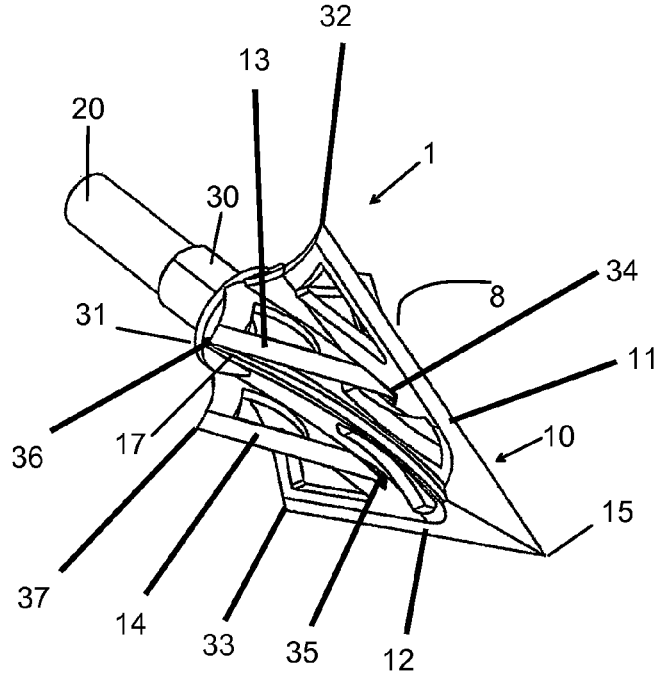
FIG. 1 illustrates a perspective view of a broadhead arrowhead in accordance with an illustrative embodiment of the present invention.

A broadhead arrowhead in accordance with a selected illustrative embodiment of the invention is shown generally at 1 in FIG. 1. The fixed blade broadhead arrowhead 1 in accordance with the present invention includes essentially three parts, a blade portion 10, a fixation portion 20 and an intermediate support portion 30. In the depicted embodiment, the three portions, i.e., the blade portion 10, the fixation portion 20 and the intermediate support portion 30. the are combined to form an integral, monolithic structure.

As can be seen in FIG. 1, the broadhead 1 according to the present invention includes the fixation portion 20 including suitable cylindrical structure at the rear or base of the arrowhead 1, for mounting to the forward portion of an arrow shaft (not shown). The fixation portion 20 is sized and proportioned to accept any of the known methods of attaching an arrowhead to an arrow shaft as is well known in the art.

For purposes of an example, it is an accepted method in the art to employ an adhesive to secure or affix the broadhead 1 to an arrow shaft (not shown). The fixation portion is sized either to fit over the end of the shaft (not shown) and attach thereto with adhesive, or to be inserted inside of a hollow shaft and attach thereto with adhesive.

Figure 4:
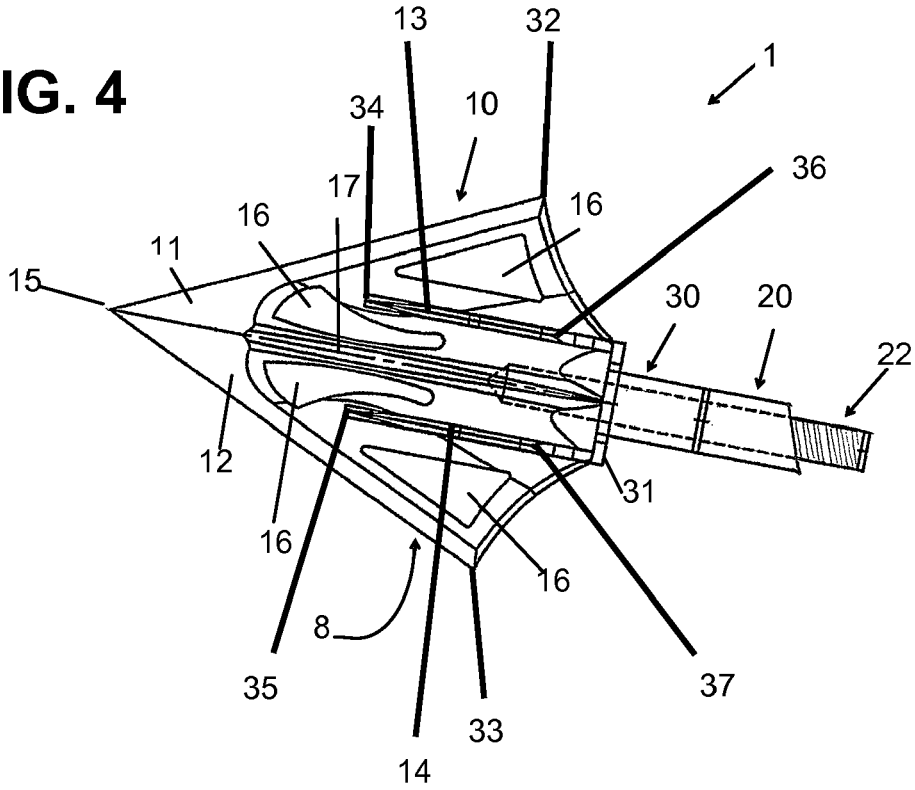
FIG. 4 illustrates a side plan view of the broadhead arrowhead in accordance with the illustrative embodiment of the present invention.

As an example of an alternative fixation portion 20 and method, FIG. 4 illustrates a male threaded portion 22 which is configured to be threadably and rotatably attached to a corresponding female threaded portion in a threaded bore on the front of the arrow shaft (not shown). The broadhead 1 in accordance with the invention may be secured by the fixation portion 20 to the arrow shaft (not shown) by any methods which are well-known in the art.

While handling the broadhead, it may be desirable to use a broadhead wrench (not shown) for the protection of the user's fingers while assembling, removing or installing broadheads on the shaft. The wrench (not shown) is adapted to hold blades in position until the securing or fixing operation is completed. The wrench (not shown) is also used to tighten the broadhead on the arrow shaft when it is screwed onto the arrow shaft.

Figure 5:
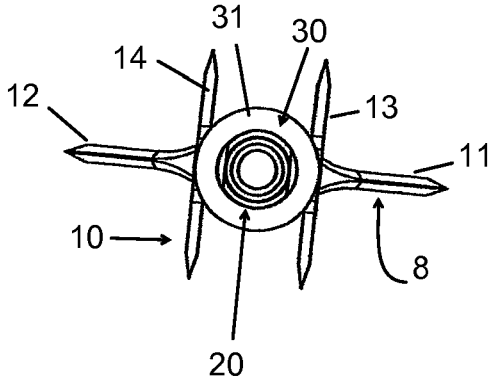
FIG. 5 illustrates a rear end view of the of the broadhead arrowhead of FIGS. 1-4.

The support portion 30 attaches to, and is integrally formed with the fixation portion 20, and supports the blade portion 10 thereon in fixed position and in proper alignment. The support portion 30 is generally cylindrical in shape and slightly larger in diameter than the fixation portion 20. The support portion 30 is open at the forward end to accommodate the blade portion 10. As can best be seen in FIGS. 4 and 5, the support portion 30 is ferrule-like and coaxial with the fixation portion 20 and blade portion 10. As best seen in FIG. 4, the support portion 30 includes a flat, enlarged circular platform 31 that supports the blade portion 10 on the fixation portion 20.

It has been observed that in use, the modified H-shaped arrangement (see FIGS. 2 and 5) of blades used in the broadhead 1 according to the depicted embodiment aids in the rapid hemorrhaging of a target animal when the animal is hit, by creating a significantly larger conduit or aperture for bleeding to occur than is made by previously know broadheads, thus shortening the time between an arrow strike and resultant death. It is applicant's understanding and belief that the hole made by the broadhead according to the invention is approximately twice as large as a hole made by a previously known broadhead having an X-shaped outline as viewed from the front of the arrowhead.

The support portion 30 and the fixation portion 20 can be made from various materials of sufficient strength, to provide enthusiasts and hunters with the specific weight grain (mass) for the desired application depending on the type of target and distance to the target. Acceptable materials could include titanium and other high strength metals, plastic, and ceramics. The broadhead 1 could be constructed entirely from one type of material or these materials may be selected for each portion 10, 20 and 30 to meet the need of the specific weight grain requirement of the broadhead.

The blade portion 10 is an important feature of the invention, since the blades can affect the flight of the arrow and can affect the speed and effectiveness of the hemorrhaging of the target.

Figure 2:
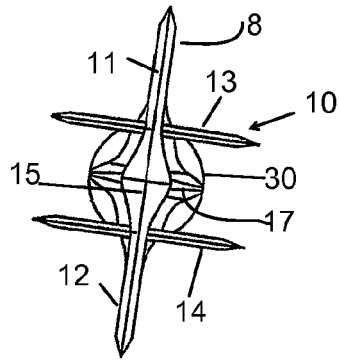
FIG. 2 illustrates a front view of the broadhead arrowhead of FIG. 1.

As can best be seen in FIG. 2, from the front view of the broadhead 1, the blade portion 10 forms a double cruciform shape or modified H-shape, where the crossbar of the H extends out beyond the side portions thereof on both she sides of the structure. As shown in FIGS. 1 and 4, the blade portion 10 of the broadhead 1 includes a relatively large main blade 8 having a pointed front main blade tip 15 and two opposed cutting edges 11, 12. Each of the opposed cutting edges 11, 12 extends from the main blade tip 15 to a rearward main blade base 32, 33, respectively. Optionally, but not necessarily, the main blade 8 may include an integrally formed central skirt portion 17 extending outwardly thereon to join the platform 31, as shown.

The blade portion 10 also includes two smaller secondary, or cross blades 13 and 14 permanently connected to the main blade 8 substantially at right angles thereto, to make up a single integrated blade-unit, wherein the two cross blades extend toward the main blade tip 15. As shown in FIG. 2, the cross blades 13, 14 are substantially parallel to one another. Similar to the main blade 8, each of the cross blades 13, 14 have a cross blade tip 34, 35 a cross blade base 36, 37, respectively.

Each of the blades 8, 13, and 14 is vented as shown at 16 on the main blade 8, to aid in hemorrhaging and to lighten the weight of the blade portion 10. The vents 16 can be provided in any number of known shapes (circular, triangular, etc.) as long as the strength of the blades is not adversely affected by the loss of material. The vents 16 also provide for a lighter arrowhead, depending on the needs of the hunter and weather (wind) conditions.

Rear portions of the blades 8, 13 and 14 may be tapered towards the support portion 30, as shown, to minimize air disturbance of the arrow in flight, but if so desired, the blades 8, 13 and 14 could have straight rear portions (not shown) coincident with the base portion 31 of the support portion 30. However, the illustrative embodiment includes the rear portions of the blades 8, 13 and 14 tapering towards the platform 31 from the maximum diameters thereof.

Figure 3:
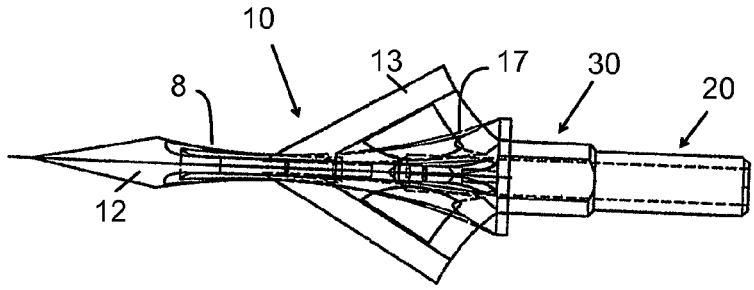
FIG. 3 illustrates a top plan view of the broadhead arrowhead of FIGS. 1-2.

The opposed cutting edges 11, 12 of the main blade 8 and of the cross blades 13, 14 provide the main cutting or penetration portion of the arrow having a leading edge including a cutting edge starting at the main blade tip 15. The cross blades 13, 14 are substantially shorter in length than the main blade 8 as best seen in FIGS. 1 and 3, thus also making the cross blades 13, 14 shorter in the width of the broadhead 1.

The blade portion 10 may be constructed of titanium or any other material that would retain a sharp edge thereon.

However, the present invention is not limited to metallic fabricated blades but includes blades fabricated using any of a variety of known technologies which permit the shaping or machining of the various edges to provide an edge treatment such as, but not limited to, machining, investment casting or fine blanking. Thus, blades fabricated by any of these or other known technologies are considered to be within the scope of the present invention.

A broadhead in accordance with one illustrative embodiment of the invention may be integrally formed from titanium metal; however, it is contemplated in an alternate embodiment that other suitable metals could be utilized, and/or that select portions of the broadhead could each be formed from different metals, wherein such metals could include, but are not limited to, steel, aluminum, brass, carbon-graphite, boron, or other suitable metals or metal alloys and ceramic and/or ceramic/metal alloys as discussed above.

The blades 8, 13, 14 of the present invention are made from a material which may be selected from a group including stainless steel, carbon steel, ceramics, titanium or other suitable materials, including combinations of the named materials. While these named materials contain desirable properties such as sufficient hardness to provide a rigid blade for the present invention, other metals or materials may be used which would not depart in scope from the present invention.

While in the foregoing specification this invention has been described in relation to certain preferred embodiments thereof, and many details have been set forth for purpose of illustration, it will be apparent to those skilled in the art that the invention is susceptible to additional embodiments and that certain details described herein can be varied considerably without departing from the basic principles of the invention.

What is claimed is:

1. An arrowhead for mounting to the forward portion of an arrow shaft, said arrowhead comprising:

a blade portion comprising a pair of main blades and at least two pairs of cross-blades, the cross-blades from each respective pair of cross-blades being substantially parallel to each other and the first pair of cross-blades being non-planar with the second pair of cross-blades, each of the main blades and cross-blades having a leading edge including a cutting edge, a point, and a base end, the point of each cross-blade being positioned forward of the base end of each main blade;

a support portion coaxial with the blade portion; and a fixation portion attached to said support portion and being coaxial therewith; the fixation portion attaching the arrowhead to an arrow shaft.

2. An arrowhead according to claim 1, wherein the blade portion has a double cruciform shape.

3. An arrowhead according to claim 1, wherein the fixation portion mates with matching portions on said arrow shaft.

4. An arrowhead according to claim 1, wherein the support portion, fixation portion, and blade portion form an integral, monolithic unit.

5. An arrowhead according to claim 1, wherein the main blades form a penetrating point at the front of the blade portion.

6. An arrowhead according to claim 1 wherein the cross-blades are shorter in length than the main blades.

7. An arrowhead for mounting to the forward end of an arrow shaft, said arrowhead comprising a blade portion comprising a main blade and a pair of spaced apart cross-blades, the main blade having two opposed cutting edges which converge toward each other at a main blade tip, each of the opposed cutting edges having a rearward main blade base, the cross-blades being parallel to each other and fixed to the main blade, each of the cross-blades having a cross-blade tip at the forward end thereof and being disposed substantially perpendicular to the main blade, wherein the cross-blade tips are positioned forward of the main blade bases.

8. The arrowhead of claim 7 which further comprises:

a support portion coaxial with the main blade; and a fixation portion attached to the support portion and being coaxial therewith, the fixation portion being attachable to an arrow shaft to mount the blade portion thereto.

9. The arrowhead of claim 7 wherein the main blade has a length greater than the length of the cross-blades.

10. The arrowhead of claim 7 wherein the blade portion has a double cruciform shape.

11. The arrowhead of claim 7 wherein the main blade and each of the cross-blades tapers toward the support portion.

12. The arrowhead of claim 7 wherein the main blade and each cross-blade has a vent formed therein for facilitating hemorrhaging of an animal struck with the arrowhead and for lightening the weight of the arrowhead.

* * * * *